114-242
5/31/77 XR 4,026,049

United States Patent [19]

Johnson

[11] 4,026,049

[45] May 31, 1977

[54] ARTICULATING DREDGE

[76] Inventor: Alton J. Johnson, 902 Tanglewood Drive West, Irving, Tex. 75061

[22] Filed: Dec. 5, 1975

[21] Appl. No.: 637,898

[52] U.S. Cl. ..... 37/67; 37/72; 114/26; 114/242

[51] Int. Cl.[2] ..... E02F 3/88

[58] Field of Search ..... 37/54, 58, 66, 67, 72, 37/73, 195; 114/235 R, 235 B

[56] References Cited

UNITED STATES PATENTS

| | | | |
|---|---|---|---|
| 607,237 | 7/1898 | Heath | 37/67 |
| 703,817 | 7/1902 | Perry | 37/66 |
| 822,865 | 6/1906 | Payne | 37/67 |
| 922,160 | 5/1909 | Lane et al. | 114/235 R |
| 2,109,730 | 3/1938 | Torneau | 37/73 |
| 2,850,814 | 9/1958 | Ellicott, Jr. | 37/67 |
| 3,230,721 | 1/1966 | DeLong et al. | 37/54 |
| 3,902,448 | 9/1975 | Davis | 37/73 |
| 3,919,791 | 11/1975 | Smith | 37/67 |

*Primary Examiner*—Trygve M. Blix
*Assistant Examiner*—Jesus D. Sotelo
*Attorney, Agent, or Firm*—Howard E. Moore; Gerald G. Crutsinger

[57] ABSTRACT

An articulating dredge comprising a barge with a spud arrangement to maneuver the barge and an articulated hull section pivotally secured to the bow of the barge by a trunnion such that the hull section pivots between the port and starboard sides of the barge and exerts a bouyant force on the cutter assembly to relieve shear forces on the trunnion. The articulated hull section supports the cutter assembly of the dredge machine and the suction pipe to the pump located on the barge to enable larger cutters to be constructed and pivotally supported. The preferred embodiment of the articulated hull section has a planetary gear adapted to rotate along a stationary gear segment secured to the bow to pivot the hull section. Another embodiment has a hydraulic ram adapted to move the hull section and another embodiment has rope and pulley assemblies to move the hull section from side to side. The articulated hull section comprises a hollow hull, having a dead air space therein to lift the cutter upward.

10 Claims, 9 Drawing Figures

ARTICULATING DREDGE

BACKGROUND

Dredges are used to increase the depth of rivers and bodies of water for recreational purposes or for laying pipes in the river bed at an increased depth so that they will not interfere with water vehicles normally using the body of water.

Heretofore, problems have occurred in attempting to dredge narrow bodies of water such as a stream or river because the standard dredge is pivoted about an aft point of the barge. Therefore when using a standard barge in a narrow stream, the bow of the barge will strike the bank of the stream before the cutter does preventing the undercutting of the bank.

Barges have been developed having ladder type cutters which are pivotally secured to the bow of the barge making the cutter rotatable as the barge moves forward such as the type described in U.S. Pat. No. 2,963,801. However, these barges are restricted in size because the trunnion cannot support the weight of the ladder and suction pipe which cause shear forces on the trunnion greater than the trunnion can withstand. The restriction to smaller dredging machines limits their use in field operations because of their inability to move large quantities of silt and other material in the shortest period of time.

SUMMARY

I have devised an improved articulating dredge comprising a main barge and a smaller articulated hull section pivotally secured to the bow of the barge by a trunnion. The articulated hull section provides a platform to which the cutter assembly is secured such that it pivots in a vertical plane. The articulated hull section exerts an upward pressure to support the cutter assembly to relieve shear forces on the trunnion.

In the preferred embodiment, a motor is provided to drive a planetary gear across a stationary gear segment which is rigidly secured in a semi-circular fashion across the bow of the barge. The planetary gear is rotatably secured to the articulated hull section and moves along the sun or stationary gear segment to rotate the hull section between the port and starboard sides of the barge.

Roller gears are provided to support the stationary gear segment to prevent the articulated hull section from moving out of alignment with the main barge placing stress upon the trunnion and a support roller is provided between the hull gear and the articulated hull section to prevent movement downwardly which places stress on the trunnion support.

The second embodiment of the invention uses a hydraulic ram to pivot the articulated hull section and a third embodiment of the ram utilizes a winch and pulley arrangement to pivot the articulated hull section.

A primary object of the invention is to provide dredging apparatus which can pivot allowing access by the cutter to the widest point before contact is made by the barge allowing wider dredging operations in narrow streams or bodies of water.

A further object of the invention is to provide a means to support larger dredging cutters which are able to articulate or pivot about the bow of the barge without placing undue stress upon the pivot point.

A still further object of the invention is to provide an articulating dredge which is able to support large transport pipes to the pump located on the main barge without undue shear force being placed on the pivot point.

Other and further objects of the invention will become apparent upon the detailed study of the description and the drawings annexed hereto.

DESCRIPTION OF THE DRAWINGS

Drawings of the preferred embodiments of the invention are annexed hereto so that the invention may be more fully understood, in which.

Numeral references have been employed to designate parts of the elements and like numerals are used to designate like parts throughout the various figures of the drawings.

DESCRIPTION OF A PREFERRED EMBODIMENT

Figure 1:
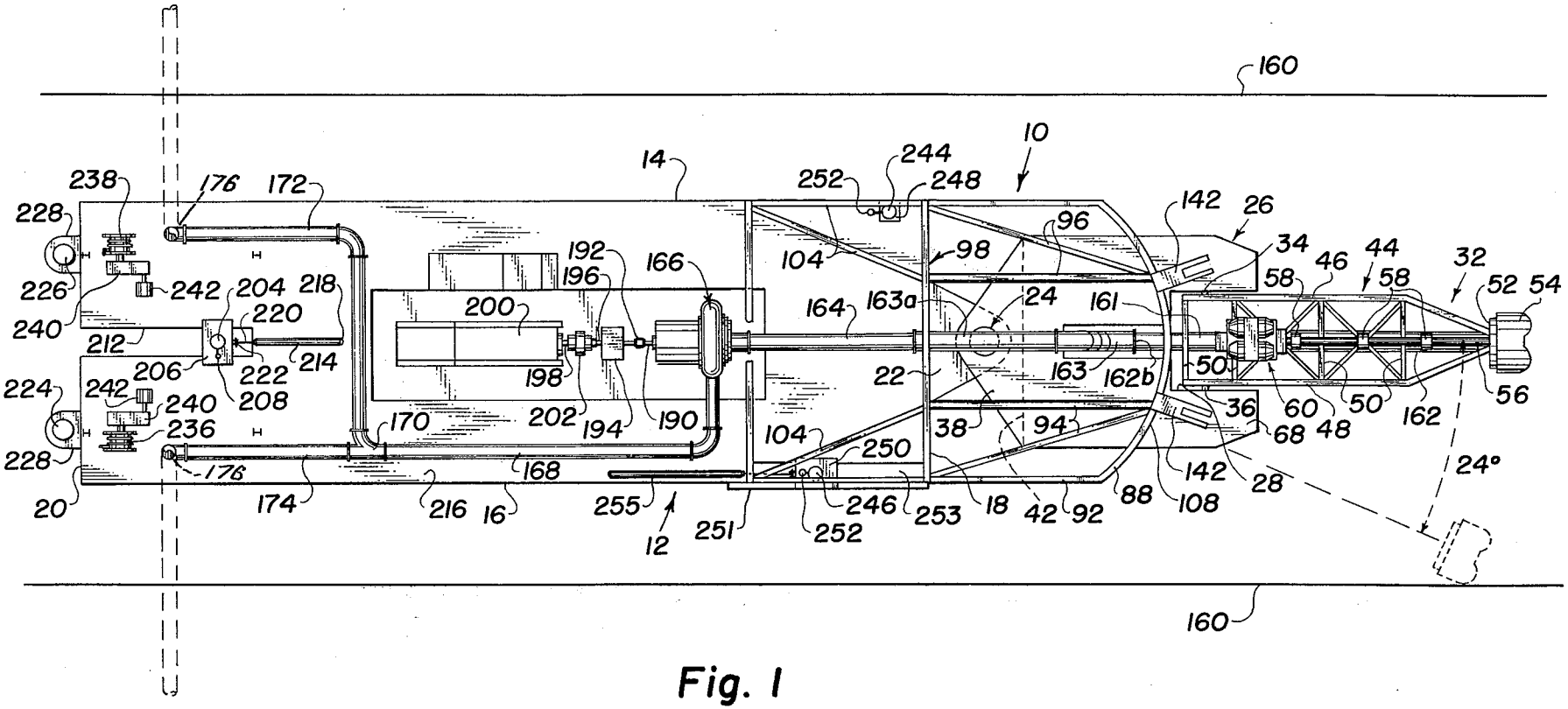
FIG. 1 is a plan view of the dredge with parts broken away to more clearly illustrate the invention.
Figure 2:
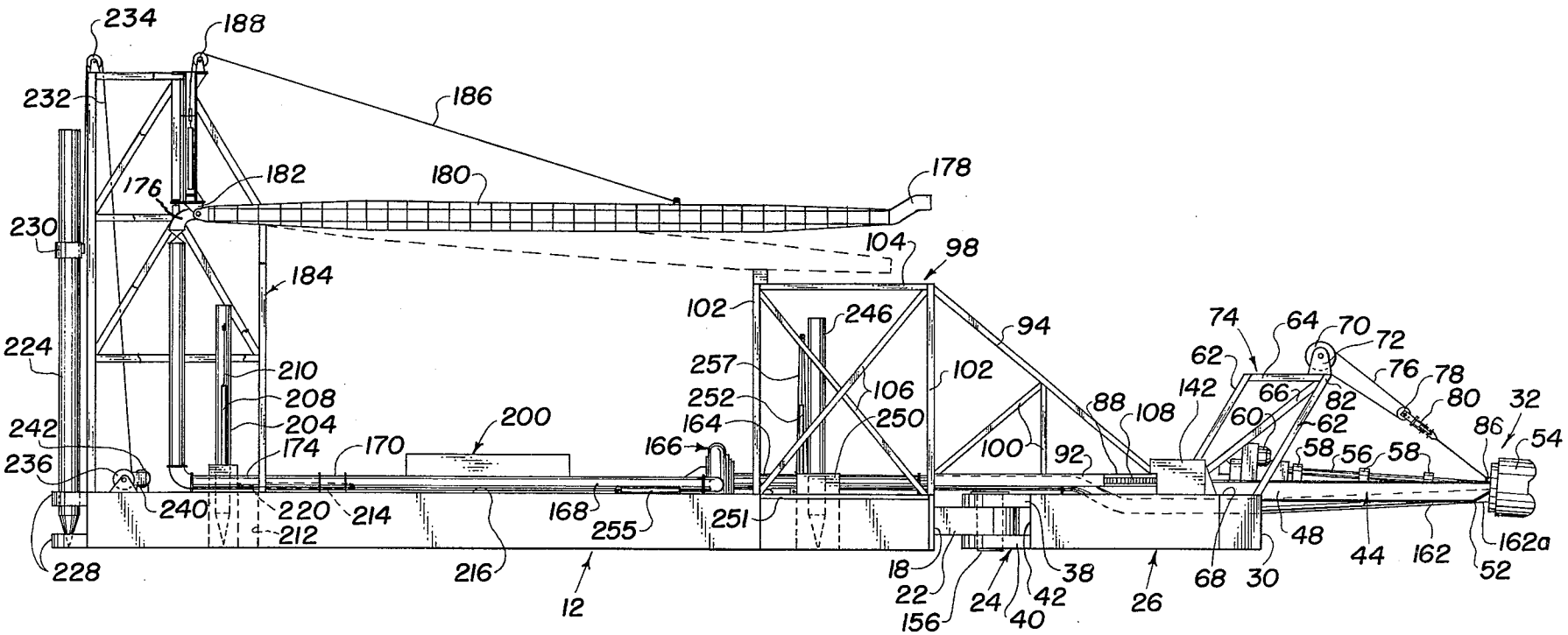
FIG. 2 is a side elevational view illustrating the dredge with diagrammatic representations of the power and control configurations.

Referring to FIGS. 1 and 2 of the drawings, the dredge is generally referred to by the numeral 10 and comprises a barge 12 having a port side 14, a starboard side 16, a bow 18 and an aft side 20. The bow 18 of the barge 12 has a generally triangular shaped tongue 22 having a passage 150 formed therethrough rigidly secured to the central portion of the bow 18 to support the trunnion 24. The trunnion 24 pivotally secures the articulated hull section 26 to the bow 18 of the barge 12.

Figure 3:
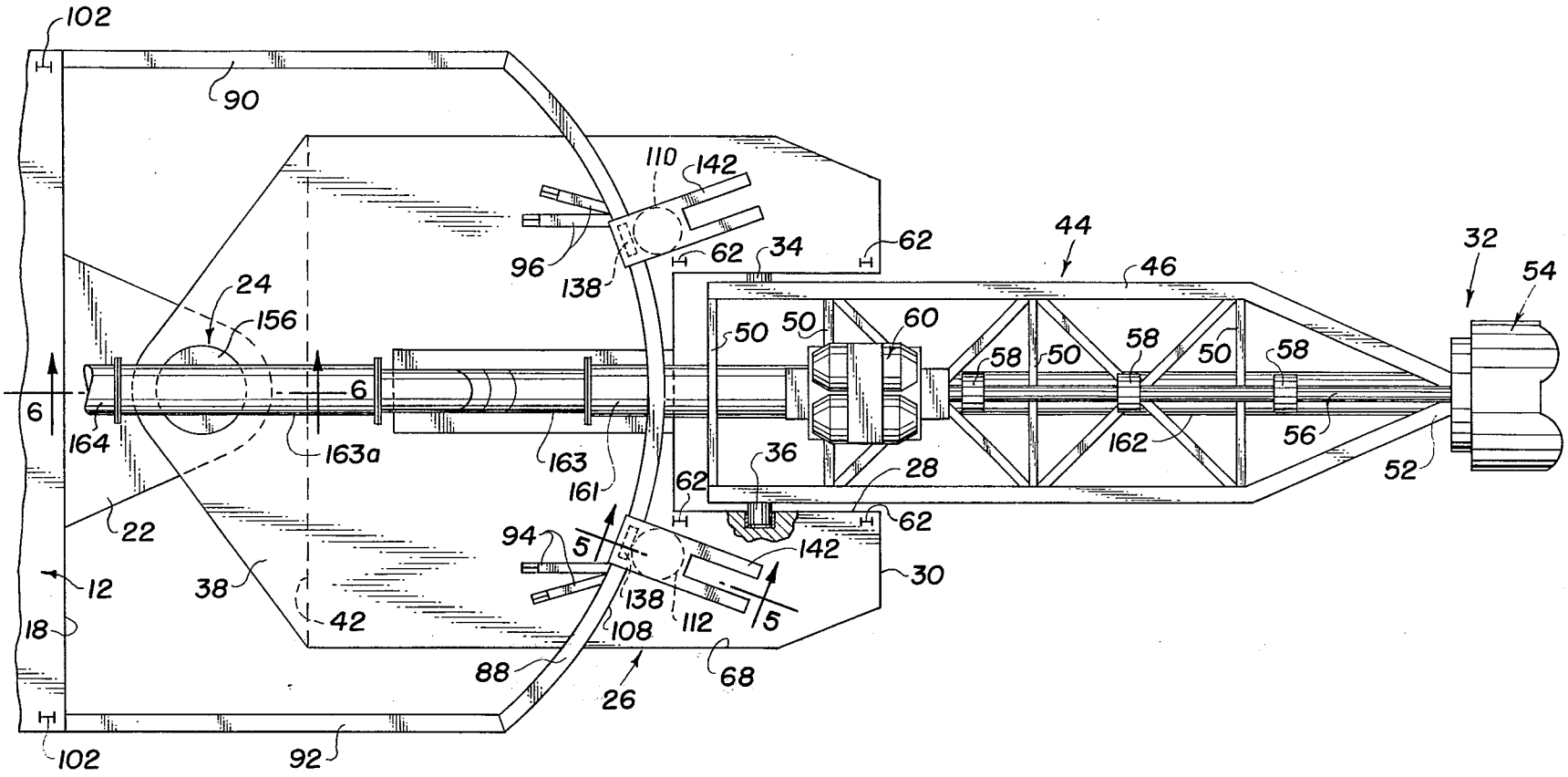
FIG. 3 is an enlarged plan view of the articulated hull section.
Figure 4:
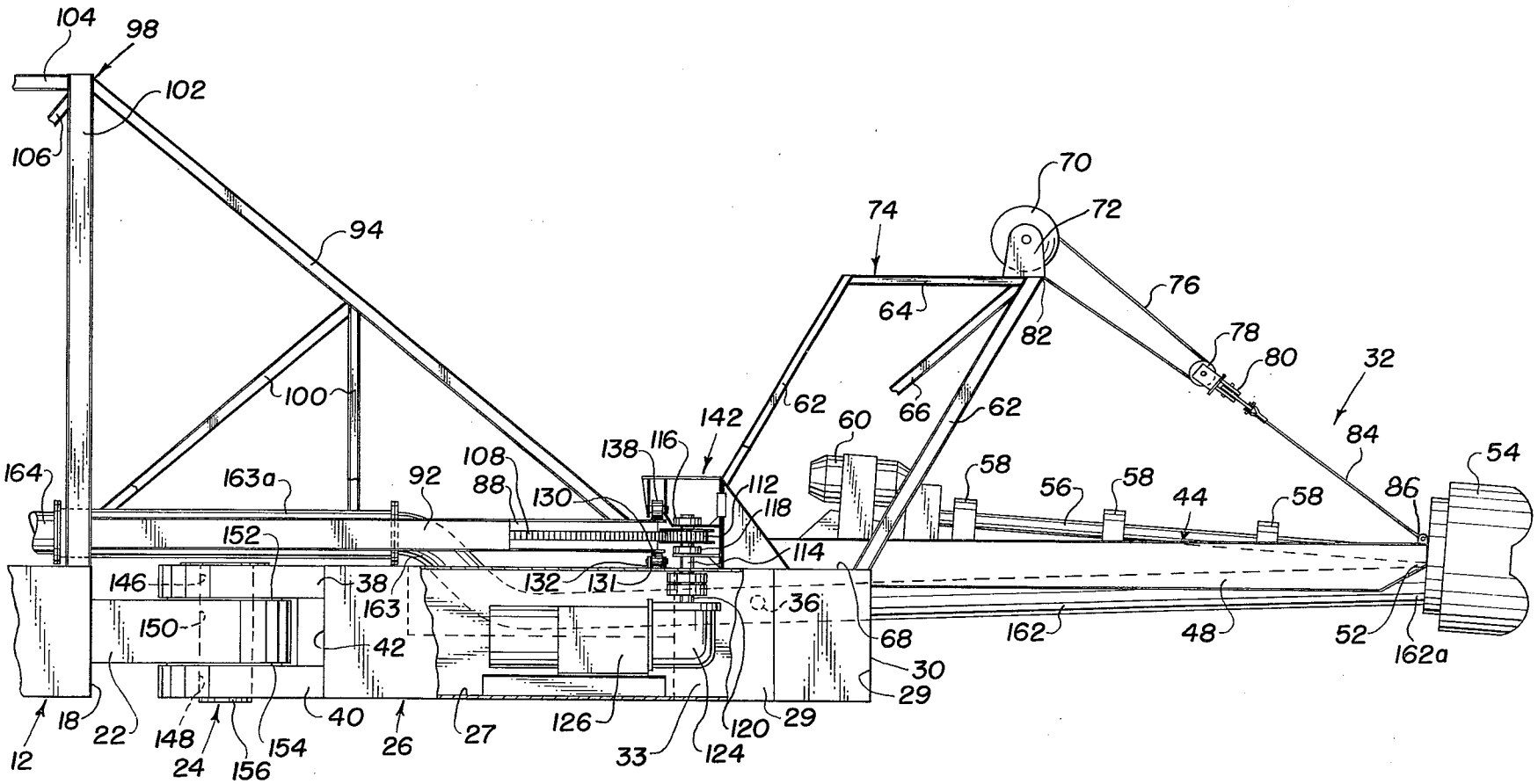
FIG. 4 is an enlarged side elevational view of the articulated hull section with parts broken away to more fully illustrate the invention.
Figure 6:
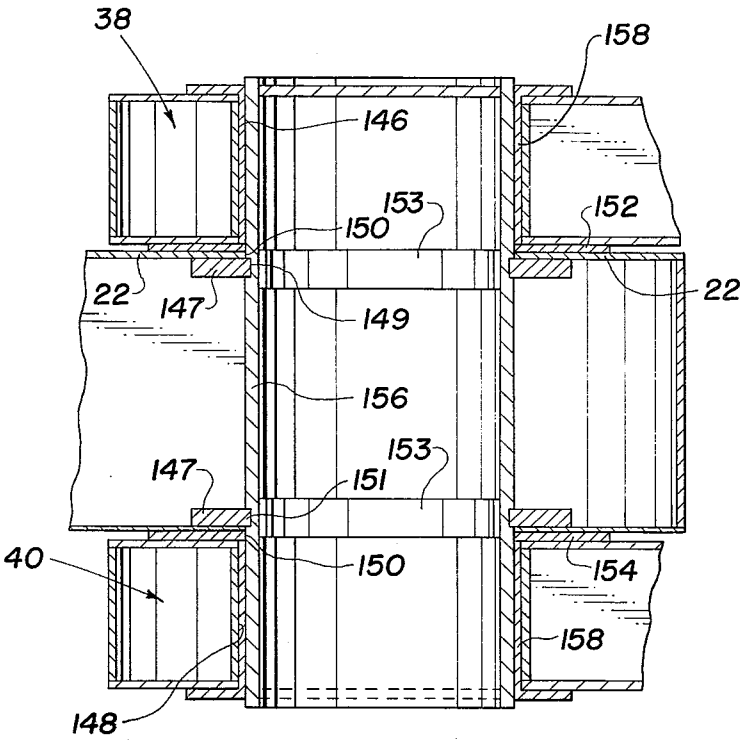
FIG. 6 is a cross-sectional view taken along line 6—6 of FIG. 3.

The articulated hull section 26 has a passage 28 formed in the bow end 30 such that the cutter assembly 32 may be pivotally secured thereto by stub shafts 34 and 36 as best illustrated in FIGS. 1 and 3 of the drawings, allowing movement of the cutter 54 in a vertical plane. As best illustrated in FIGS. 2 and 4, the articulated hull section 26 comprises a flat bottom hull having upwardly extending sides approximately the same height as the barge 12. The articulated hull section 26 exerts an upward bouyant force to support the weight of the cutter assembly 32 and relieve shear forces on trunnion 24. The bouyant force is caused by the hollow compartments 33 formed between the hull 27, sides 29, and deck 68 creating a pontoon under the cutter assembly 32. Yoke members 38 and 40 extend outwardly from the aft side 42 of the articulated hull section 26 to form the trunnion assembly 24.

The cutter assembly 32 comprises a ladder frame 44 having two parallel beam members 46 and 48 spaced apart by cross members 50. The beams 46 and 48 bend inwardly to form a pointed end 52. A cutter 54 is rigidly secured to the cutter drive shaft 56 which is journalled through pillow blocks 58 rigidly secured to cross members 50. Drive means such as an air motor 60 is provided to rotate cutter drive shaft 56.

As best illustrated in FIGS. 2 and 4, a forward gantry 74 is formed by upwardly extending members 62 spaced by cross members 64. The forward gantry 74 is reinforced by braces 66 secured to the upper deck 68 of the articulated hull section 26 to provide support for the ladder hoisting drum 70.

The ladder hoisting drum 70 is rotatably secured between ears 72 on the cross member 64 of the forward gantry 74. A cable 76 is secured from drum 70 through guide pulley 78 of equalizer assembly 80 to a lug 82 on the upper portion of the forward gantry 74. The equalizer 80 has the first end of a cable 84 rigidly secured thereto with the second end of cable 84 rigidly secured to a lug 86 on end 52 of ladder frame 44.

From the foregoing it should be readily apparent that as ladder hoisting drum 70 is rotated in a couterclockwise direction as viewed in FIG. 4, cable 76 is drawn around the drum 70 the cutter assembly 32 which is moved in a vertical plane out of the water as the ladder frame 44 pivots on stub shafts 34 and 36. Rotation of the ladder hoisting drum 70 in a clockwise direction as viewed in FIG. 4 lowers the ladder assembly 32 vertically into the body of water.

A stationary gear segment supporting structure is provided on the bow 18 of the barge 12 comprising a curved I-beam. Girder 88 is supported by outwardly extending girders 90 and 92 rigidly secured to the bow 18 of barge 12. The curved girder 88 is reinforced by angular support braces 94 and 96 spaced between the curved girder 88 and the upper portion of the barge gantry 98. Braces 100 as best illustrated in FIGS. 1—4 are provided for strength. The barge gantry 98 comprises a generally cubical structure having upwardly extending members 102 and horizontally spaced members 104 forming the top thereof with cross braces 106 for rigidity.

Figure 5:
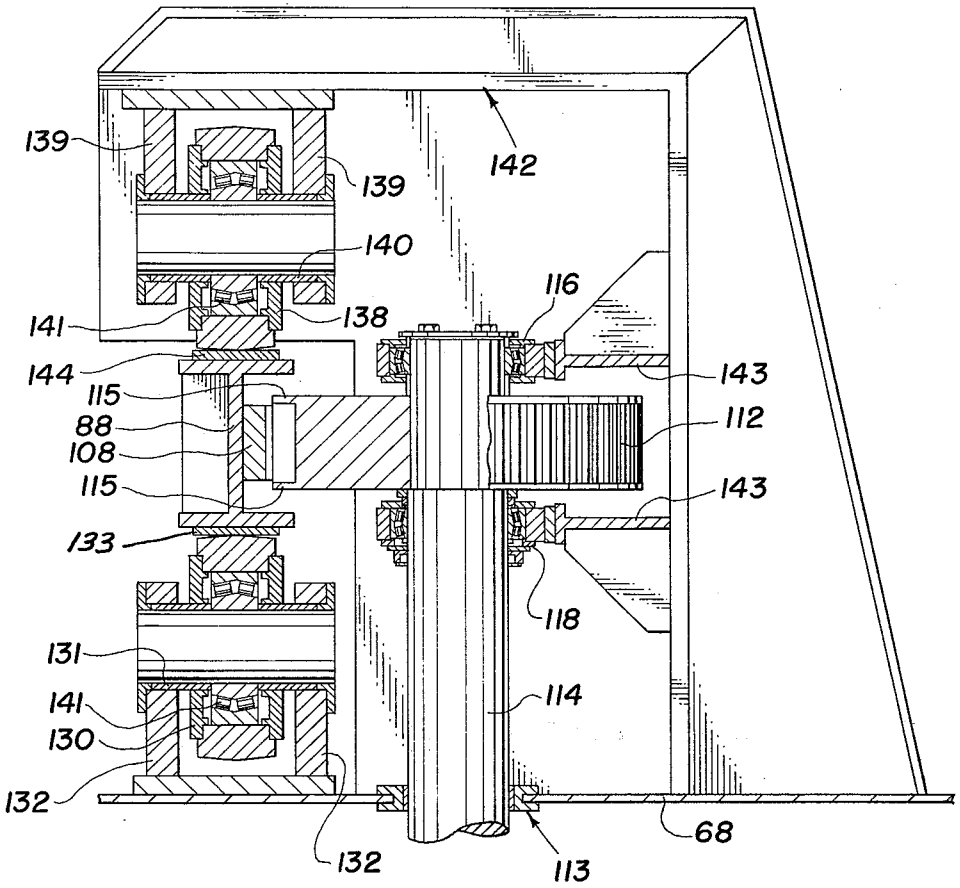
FIG. 5 is an enlarged partially sectionalized elevational view taken along line 5—5 of FIG. 3 of the stationary gear segment and pinion gear with support wheels.

A stationary gear segment 108, FIGS. 2, 4, and 5, is rigidly secured to curve girder 88 to form a rack toothed gear about the bow 18 of the barge 12. A pair of planetary gears 110 and 112 are rotatably secured to articulated hull section 26 and extend upwardly from the deck 68. The planetary gears 110 and 112 are positioned to engage the stationary gear segment 108 such that as the planetary gears 110 and 112 are rotated, they move along the gear segment 108.

As best illustrated in FIGS. 4 and 5 of the drawings, the planetary gears 110 and 112 are rigidly secured to shafts 114 between roller bearings 116 and 118. Shaft 114 is journalled through bearing 113 and deck 68 and connected to the output shaft 120 of transmission 124 by connector 122. Means to drive transmission 124 is provided such as a swing drive reversible air motor 126 rigidly secured to support block 128 in the hollow portion of the articulated hull section 26. Motor 126 may also be a hydraulic motor or electric motor or the like.

A support roller 130 is rotatably secured between lugs 132 on shaft 131 and adapted to rotate on track 133 secured to the lower edge of curved girder 88 to prevent upward movement of the articulated hull section 26 to prevent undue strain on trunnion 24. A second wheel 138 is rotatably secured to shaft 140 which is rigidly secured to lugs 139 secured to support bracket 142 anchored to deck 68. The wheel 138 rotates over a wear track 144 secured to the upper side of curved girder 88 to prevent downward movement of the articulated hull section 26 which would produce undue strain on trunnion 24. Wheels 130 and 138 are provided with bearings 141 as best illustrated in FIG. 5.

Outwardly extending lugs 143 engage roller bearing 116 and 118 urging planetary gears 112 and 110 into engagement with stationary gear segment 108. It should be noted that planetary gears 112 and 110 have flanges 115 which extend over and under stationary gear segment 108 to maintain alignment of the two gears.

Trunnion 24 comprises a tongue 22 which extends outwardly from the barge 12 with yokes 38 and 40 extending outwardly from the aft side 42 of articulated hull section 26 each having a passage 146 and 148 formed therein which aligns with passage 150 in tongue 22. The yokes 38 and 40 are spaced from tongue 22 by wear plates 152 and 154 having a central passage formed therein. A trunnion pin 156 is journalled through passages 146, 150 and 148 in trunnion 24. Bushings 158 constructed of bronze or the like are provided in passages 146 and 148 to support yokes 38 and 40. Annular retaining plates 147 are rigidly secured to the tongue 22 by welding or the like. The plates 147 are slideably disposed in annular grooves 149 and 151 formed in pin 156 to retain same. Reinforcement bands 153 strengthen pin 156.

As best illustrated in FIG. 1, the articulated hull section 26 may be moved by rotation of planetary gears 110 and 112 which move along stationary gear segment 108 from the port side 14 to the starboard side 16. As the hull section 26 moves, cutter assembly 32 is moved between the banks of the stream. The specific angle of rotation is determined by the physiological construction of the aft portion of the articulated hull section 26. As illustrated in the preferred embodiment this angle is approximately 24° from the longitudinal axis of the barge 12 which projects the cutter 54 beyond the sides of the barge 12.

An intake suction pipe 162 constructed of steel or the like is secured along ladder 44 having an end **162*a* disposed adjacent cutter 54. End 162*b* of the suction pipe 162 is connected to flexible section 161 comprised of a flexible pipe so that the suction line can bend in the vertical plane with the ladder 44. Section 163 connects section 161 with another flexible suction pipe section 163*a* for bending upon rotation of the articulated hull section 26. Suction pipe section 163*a* is rigidly secured to suction line 164 which is connected to the intake side of hydraulic suction pump 166, as best illustrated in FIGS. 1 and 2. The discharge side of pump 166 is connected to discharge line 168 which is connected to a Y-joint 170 connected to branch discharge lines 172 and 174. As best illustrated in FIGS. 1 and 2, branch discharge lines 172 and 174 extend upward along the aft side 20 of barge 12 and are connected to a flexible rotating joint 176 which is connected to the boom discharge pipe 178 as illustrated in FIG. 2 of the drawings. A boom discharge support structure 180 is formed about the boom discharge pipe 178 and is rigidly secured to trunnion 182 which is rotatably secured to the aft gantry 184. A cable 186 has a first end secured to the outward portion of the boom support structure 178 and a second end secured to winch 188** secured to gantry 184. As the winch 188 is turned, the cable lifts the boom discharge pipe 178 off of the forward gantry 98 enabling the boom structure 180 to swing the boom structure outwardly to a position shown in dashed outline in FIG. 1 such that the dredged material is deposited on the banks 160 of the river.

Shaft 190 of hydraulic suction pump 166 is secured by connector 192 to transmission 194. The input shaft 196 of transmission 194 is connected to the output shaft 198 above the drive engine 200 by connector 202.

Engine 200 may be a diesel engine which can also be used to turn a hydraulic pump, air pump, or generator for powering the various hydraulic rams and air motors provided on the dredge 10.

Means to propel barge 12 in a body of water comprises a walking or moving spud 204 slideably disposed through guide sleeve 206. A hydraulic ram 208 has a first end rigidly secured to guide sleeve 206 and a piston rod 210 extending outwardly connected to the upper end of walking spud 204. As piston rod 210 is extended from hydraulic cylinder 208, walking spud 204 is lifted upwardly. As piston rod 210 is retracted, the walking spud 204 is lowered until it contacts the bottom of the body of water. As best illustrated in FIG. 1, a passage 212 is formed in the aft side 20 of barge 12. The walking spud guide sleeve 206 is slideably disposed in said passage 212. A hydraulic ram 214 is rigidly secured at one end to the deck 216 of barge 12 by pin 218. A piston rod 220 extends outwardly from the hydraulic ram 214 and is rigidly secured by clevis 222 to guide sleeve 206. As piston rod 220 is extended from hydraulic ram 214, barge 12 is moved relative to guide sleeve 206 which is stationary when walking spud 204 is implanted in the river bed thus moving the barge 12 forward. For reverse movement of the barge 12, walking spud 204 is moved upward and toward the aft side 20 of barge 12 then implanted in the river bed by downward movement of piston rod 210 into hydraulic cylinder 208 and then piston rod 220 is retracted into ram 214 pulling the barge 12 toward the walking spud 204.

Stationary spuds 224 and 226 are journalled through lugs 228 rigidly secured to the aft side 20 of barge 12. A guide sleeve 230 is rigidly secured to the aft gantry 184 to maintain vertical movement of the stationary spuds 224 and 226. Cables 232 having their first ends rigidly secured to stationary spuds 224 and 226 are threaded over guide pulleys 234 and connected to winch 236 and 238. As the winches 236 and 238 are rotated, cables 232 move stationary spuds 224 and 226 vertically in lugs 228. Winches 236 and 238 are rotatably secured to the output shaft of transmission 240 which are driven by air motors 242 or the like.

At the bow end 18 of barge 12 working spud 244 is journalled through guide sleeve 248. A hydraulic ram 252 is provided to lift working spud 244 vertically in guide sleeve 248. When the dredge is in operation the stationary spud 248 is lowered into the river bed to stabilize the bow 18 of the barge 12.

A guide spud 246 is journalled through sleeve 250 on the starboard side 16 of the bow 18. Sleeve 250 is slideably disposed along guide rail 251 on the starboard side 16 on deck 216. A passage 253 is formed along the starboard side of barge 12 through which guide spud 246 passes. When the barge is being moved forward along the longitudinal axis of the barge 12, the spud 246 is lowered to the bottom of the river so as to guide the barge 12, preventing it from shifting off course. A hydrualic ram 255 is connected between sleeve 250 and the deck 216 to aid in moving the barge 12. Means such as a hydraulic cylinder 252 is provided to lift cable 257 having one end secured to sleeve 250 and the other to spud 246 which will move spud 246 vertically.

Operation of the hereinbefore described invention is as follows:

As the dredge 10 moves down a narrow stream or body of water the ladder 44 is lowered vertically into the body of water wherein cutter 54 is rotated. The cutter 54 cuts roots and silt away from the bottom where it may be drawn through suction line 162 by a pump 166 and discharged through boom discharge line 178 on the banks of the body of water.

The articulated hull section 26 is pivoted by rotation of planetary gears 110 and 112 by motors 126 to move the articulated hull section 26 between a position on the port side 14 to a position on the starboard 16 of barge 12 and back again. As the articulated hull section 26 is moved the cutter assembly 32 removes silt, dirt and the like along the circumference of the arc of the cutter assembly 32.

The dredge 10 is projected forward a small amount by extending piston rod 220 from hydraulic ram 214 when walking spud 204 and guide spud 246 are in the lowered position. The dredging process is repeated until a dredging operation is completed. Reverse movement of the dredge may be accomplished as hereinbefore discussed.

It should be readily appreciated that the discharge line 168 may be supported by a floating boom to any point relatively close to the dredge 10 in a manner well known in the art. It is not intended to limit this invention to the overhead boom discharge of dredged materials.

As the articulated hull section 26 is rotated working spud 244 and guide spud 246 are usually in the lowered position to add stability to the barge 12.

If it is necessary to rotate the barge 12 toward the port side 14, the stationary spud 226 is lowered into the river bed and spud 224 is raised, piston rod 220 of hydraulic ram 214 is extended thereby pivoting the barge 12 about spud 226. Likewise, if it is necessary to rotate the barge 12 toward the starboard side 16 spud 224 is lowered and spud 226 is raised as piston rod 220 is extended.

Figure 7:
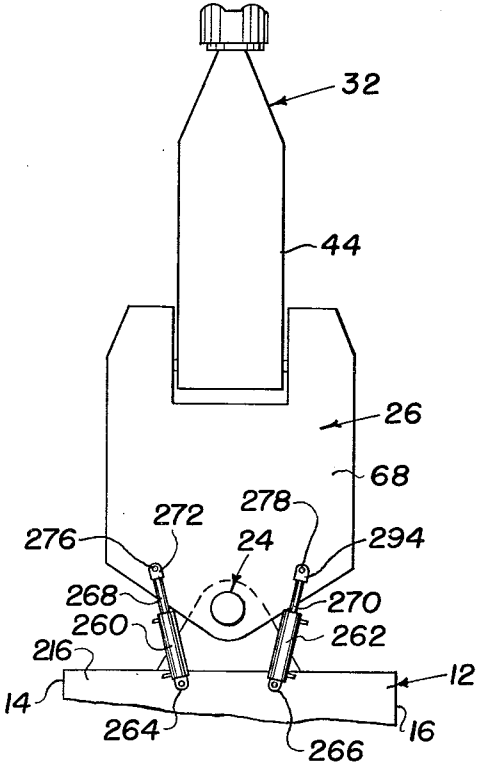
FIG. 7 is a diagrammatic plan view of the second embodiment of the rotating means of the articulated hull section.

A second embodiment of the means to rotate the articulated hull section 26 is illustrated in FIG. 7 wherein a pair of hydraulic cylinders 260 and 262 have a first end pivotally secured to shafts 264 and 266 rigidly secured to deck 216 of barge 12. Piston rods 268 and 270 are pivotally secured by clevises 272 and 274 to shafts 276 and 278 rigidly secured to the deck 68 of the articulated hull section 26. To move the articulated hull section toward the starboard side 16, hydraulic pressure (from a source not shown) is delivered to the base of hydraulic cylinder 260 and to the outward side of hydraulic cylinder 268 extending piston rod 268 and retracting piston rod 270 to rotate the articulated hull section 26 about trunnion 24. To move the articulated hull section 26 to the port side 14 hydraulic pressure is delivered from a source not shown to the base of hydraulic cylinder 262 and to the outward side of hydraulic cylinder 260 retracting piston rod 268 and extending piston rod 270.

Figure 9:
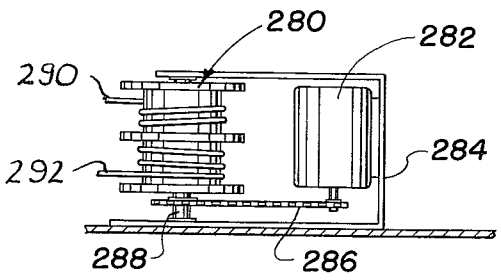
FIG. 9 is an enlarged side elevational view taken along line 9—9 of FIG. 8 illustrating the winch and drive system.

A third embodiment of the means to rotate articulated hull section 26 comprises a winch 280 rotatably secured to deck 16 at the bow end of barge 12 as illustrated in FIG. 9. A reversible air motor 282 or the like is rigidly secured to support bracket 284 and drives chain 286 to rotate shaft 288. A pair of cables 290 and 292 have a first end secured around winch 280 and are threaded through guide pulley 294 rotatably secured on the port side 14 of barge 12 and guide pulley 296 pivotally secured on the starboard side 16 of barge 12 with a second end of cables 290 and 292 secured about lugs 298 and 300 positioned on the port and starboard side of articulated hull section 26 respectively.

Figure 8:
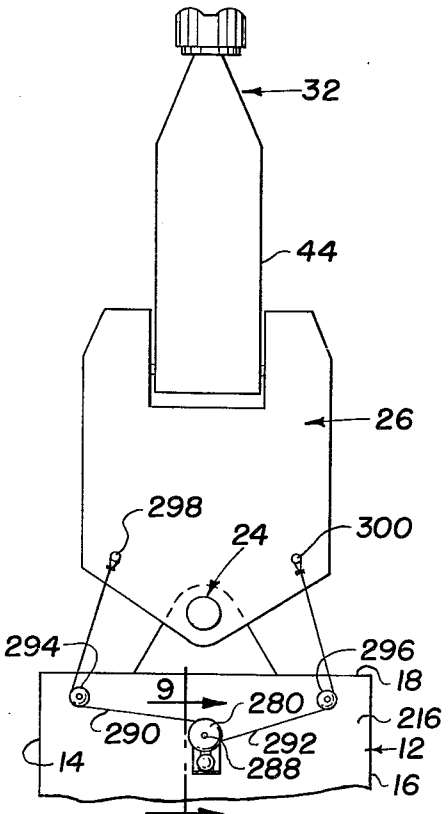
FIG. 8 is a diagrammatic plan view of the third embodiment of the rotating means to move the articulated hull section.

It should be readily apparent from the foregoing that the rotation of winch 280 in the clockwise direction as illustrated in FIG. 8 would draw cable 292 about the winch 280 and release cable 290 pulling articulated hull section 26 toward the starboard side 16 of barge 12. Rotation in the counterclockwise direction as viewed in FIG. 8 draws cable 290 about winch 280 and releases cable 292 to pull the articulated hull section 26 toward the port side 14 of barge 12.

It should be readily apparent that other and further means to rotate articulated hull section 26 may be developed without departing from the basis concept thereof.

It should be readily apparent from the foregoing that each of the embodiments hereinbefore disclosed accomplishes the objects of the invention hereinbefore described.

It should be readily apparent that other and further embodiments of the invention may be devised without departing from the basic concept thereof.

Having described my invention, I claim:

1. A dredge comprising: a barge: an articulated hull section; a trunnion securing the articulated hull section to the bow of the barge; a cutter assembly; means pivotally supporting said cutter assembly on said articulated hull section to move same vertically relative to said articulated hull section; a suction line; means securing said suction line adjacent said cutter assembly; a discharge line; pump means to draw dredged material from the area about the cutter assembly and discharge same into said discharge line, said pump being positioned on the barge a stationary gear segment rigidly secured to the bow of said barge and extending outwardly from the bow of the barge over the articulated hull section, the gear segment further having an upper and lower flange formed thereon; a pinion gear rotatably secured to said articulated hull section and arranged to engage said stationary gear segment; drive means to reversibly rotate said pinion gear along said stationary gear segment to move the articulated hull section between a position on the port side of the barge to a position on the starboard side of the barge; a first support roller; a second support roller; means rotatively securing the first support roller to the articulated hull section in a position to engage the lower flange of the gear segment; and means rotatively securing the second support roller in a position to engage the upper flange on the gear segment such that movement in the vertical direction of the articulated hull section relative to the barge is limited.

2. The combination called for in claim 1 with the addition of a means to move said barge in a body of water.

3. The combination called for in claim 1 wherein the articulating hull section comprises: a flat bottom hull having upwardly extending sides, the aft portion of the hull extending outwardly toward the rear in a pointed configuration where the trunnion rotatably secures the articulated hull section to the bow of the barge and the hull section having a slot formed in the bow portion thereof to allow passage of the cutter assembly toward the bow portion of the hull section.

4. The combination called for in claim 1 wherein the trunnion comprises: a tongue having a passage formed therein, said tongue rigidly secured to the central portion of the bow of the barge; a yoke having a passage therethrough adapted to axially align with the passage in said tongue, said yoke being rigidly secured to said aft portion of said articulated hull section; and a trunnion pin disposed through said tongue and yoke.

5. A dredge comprising: a barge: an articulated hull section; a trunnion securing the articulated hull section to the bow of the barge; a cutter assembly; means pivotally supporting said cutter assembly on said articulated hull section to move same vertically relative to said articulated hull section; a suction line; means securing said suction line adjacent said cutter assembly; a discharge line; pump means to draw dredged material from the area about the cutter assembly and discharge same into said discharge line, said pump being positioned on the bar; means to move said articulated hull section between a position on the port side of the barge to a position on the starboard side of the barge; a semicircular support beam rigidly secured to the bow of said barge and extending outwardly from the bow of the barge over the articulated hull section, the support beam further having an upper and lower flange formed thereon; a first support roller; a second support roller; means rotatively securing the first support roller to the articulated hull section in a position to engage the lower flange of the support beam; and means rotatively securing the second support roller in a position to engage the upper flange on the support beam such that movement in the vertical direction of the articulated hull section relative to the barge is limited.

6. The combination called for in claim 5 wherein the means to move the articulated hull section comprises: a stationary gear segment rigidly secured to the bow of said barge; a pinion gear rotatably secured to said articulated hull section and arranged to engage said stationary gear segment; and drive means to reversibly rotate said pinion gear along said stationary gear segment.

7. The combination called for in claim 5 wherein the means to move said articulated hull section comprises: a hydraulic cylinder having a piston rod extending outwardly therefrom; a first end of said hydraulic cylinder pivotally secured to the bow of said barge; and the exposed end of said piston rod pivotally secured to said articulated hull section such that as the rod is retracted and extended the articulated hull section is moved between position on the port to a position on the starboard side of the barge.

8. The combination called for in claim 5 wherein the means to move said articulated hull section comprises: a winch; means to rotate said winch; a guide pulley on the port side of said barge; a guide pulley on the starboard side of said barge; first and second cables; means securing a first end of said first cable to the port side of the articulated hull section, said cable passing through said guide pulley on said port side of said barge and having a second end secured to said winch; and a first end of said second cable attached to the starboard side of said articulated hull section, said cable passing through said guide pulley on said starboard side of said barge and having a second end secured to said winch such that as the first cable is drawn around said winch, the second cable is unravelled from said winch and, vice versa, moving the articulated hull section between the port and starboard sides.

9. A dredge comprising: a barge; an articulated hull section having a passage formed in the central position of the bow and a deck; a tongue member having a passage formed therethrough, said tongue rigidly secured to the central portion of the bow of the barge; a yoke having a passage formed therethrough adapted to axially align with the passage in said tongue member, said yoke being rigidly secured to the aft portion of said articulated hull section; a trunnion pin slideably disposed through the passages formed in the tongue and yoke securing the articulated hull section to the barge; a cutter assembly; means pivotally securing said cutter assembly to said articulated hull section such that the cutter assembly may move vertically through a passage formed in the articulated hull section; means to move said cutter assembly vertically in the passage of said articulated hull section; means to drive said cutter assembly; a pump positioned on said barge; a suction line having a first end secured to the pump and a second end secured adjacent the cutter assembly, said suction line being adapted to move with the articulated hull section; a discharge line secured to the discharge end of said pump; a semi-circular support beam; means securing said semi-circular support beam in a position extending outwardly from the bow of said barge over said articulated hull section, said support beam having an upper and lower flange; a gear segment secured to said support beam; a shaft extending vertically from the deck of said articulated hull section; a planetary gear rigidly secured to said shaft and arranged to rotatably engage said gear segment on the support beam; means to rotate said shaft such that the planetary gear moves along the gear segment to move the articulated hull section relative to the barge; a track secured to the upper flange on said support beam; a track secured to the lower flange of said support beam; first and second support rollers; and means securing said first and second support rollers to rotatably engage the track on the upper and lower flanges of the support beam, said means being rigidly secured to the articulated hull section such that vertical movement of the hull section relative to the barge is limited.

10. A dredge comprising: a main barge; an articulated hull section; means to pivotally secure the hull section to the barge; means to move the hull section horizontally relative to the barge; a dredge cutter means secured to the bow of the hull section; and means extending outwardly from the bow of the barge and positioned over the upper portion of the articulated hull section, and support means moveably securing the means extending outwardly from the bow of the barge to the articulated hull section to limit vertical movement of the hull section relative to the barge, said support means adapted to allow horizontal movement of the hull section relative to the barge.

* * * * *